US012780516B2

(12) United States Patent
Valencia et al.

(10) Patent No.: US 12,780,516 B2
(45) Date of Patent: Nov. 3, 2026

(54) CONTAINERS WITH INTEGRAL DIVIDER HANDLES AND BLANKS THEREFOR

(71) Applicant: WestRock Shared Services, LLC, Atlanta, GA (US)

(72) Inventors: John Valencia, Johns Creek, GA (US); Alyssa J. Scherer, Duluth, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 78 days.

(21) Appl. No.: 18/014,543

(22) PCT Filed: Jul. 6, 2021

(86) PCT No.: PCT/US2021/040489
§ 371 (c)(1),
(2) Date: Jan. 5, 2023

(87) PCT Pub. No.: WO2022/010883
PCT Pub. Date: Jan. 13, 2022

(65) Prior Publication Data

US 2023/0264876 A1 Aug. 24, 2023

Related U.S. Application Data

(60) Provisional application No. 63/048,538, filed on Jul. 6, 2020.

(51) Int. Cl.
*B65D 71/58* (2006.01)
*B65D 5/00* (2006.01)
(Continued)

(52) U.S. Cl.
CPC ..... *B65D 71/0022* (2013.01); *B65D 5/001* (2013.01); *B65D 5/4295* (2013.01);
(Continued)

(58) Field of Classification Search
CPC ..... B65D 5/48014; B65D 5/46096; B65D 5/6321
(Continued)

(56) References Cited

U.S. PATENT DOCUMENTS 2,712,882 A * 7/1955 Buttery ..... B65D 5/48008 206/172
2,747,785 A * 5/1956 Fink ..... B65D 5/48008 229/117.14
(Continued)

OTHER PUBLICATIONS

International Search Report issued in PCT/US2021/040489, dated Oct. 8, 2021.

*Primary Examiner* — Christopher R Demeree
(74) *Attorney, Agent, or Firm* — Brian J. Goldberg; Rohini K. Garg

(57) ABSTRACT

A blank for a container configured to carry a plurality of articles can include a plurality of side panels configured to form a wall defining an interior space, a plurality of bottom panels connected to a the plurality of side panels and configured to interact with each other to form an autobottom. The autobottom can be configured to cover at least a portion of a bottom of the interior space in a formed position, and one or more divider handle assembly panels foldably connected to one or more of the bottom panels and configured to form a handle and to form at least one divider configured to divide the interior space into at least two compartments.

20 Claims, 7 Drawing Sheets

(51) Int. Cl.

| | |
|---|---|
| ***B65D 5/42*** | (2006.01) |
| ***B65D 5/46*** | (2006.01) |
| ***B65D 5/48*** | (2006.01) |
| ***B65D 85/34*** | (2006.01) |

(52) U.S. Cl.
CPC ..... *B65D 5/46184* (2013.01); *B65D 5/48006* (2013.01); *B65D 5/48016* (2013.01); *B65D 85/34* (2013.01)

(58) Field of Classification Search
USPC ..... 229/117.13–117.14, 117, 120.17
See application file for complete search history.

(56) References Cited

U.S. PATENT DOCUMENTS

| | | | | | |
|---|---|---|---|---|---|
| 2,830,727 | A * | 4/1958 | Stoel | B65D 71/0014 | 229/117.14 |
| 3,921,894 | A * | 11/1975 | Hackenberg | B65D 5/48016 | 229/117 |
| 4,126,266 | A * | 11/1978 | Roccaforte | B65D 5/10 | 229/164 |
| 4,266,716 | A * | 5/1981 | Austin | B65D 5/3621 | 229/116 |
| 4,318,470 | A * | 3/1982 | Montealegre | B65D 5/48008 | 229/117.14 |
| 4,345,711 | A * | 8/1982 | Fischer | B65D 5/3621 | 229/117 |
| 7,913,837 | B2 * | 3/2011 | Cuomo | B65D 71/0014 | 206/139 |
| 8,763,888 | B2 * | 7/2014 | Willman | B65D 5/542 | 229/117 |
| 2011/0204127 | A1 | 8/2011 | Brundage et al. | | |
| 2011/0204131 | A1 * | 8/2011 | Brundage | B65D 5/6608 | 493/137 |

* cited by examiner

CONTAINERS WITH INTEGRAL DIVIDER HANDLES AND BLANKS THEREFOR

CROSS REFERENCE TO RELATED APPLICATIONS

This Application is a U.S. 371 National Phase Patent Application of International PCT Patent Application No. PCT/US2021/040489, filed Jul. 6, 2021, which claims priority to U.S. Provisional Patent Application No. 63/048,538, filed on Jul. 6, 2020. The entire contents of these applications are incorporated herein by reference.

FIELD

This disclosure relates to containers and blanks therefor.

BACKGROUND

Certain containers for carrying certain items can be difficult to form for an end user, and/or can be difficult to carry once formed. Additionally, if preformed, the certain containers can be voluminous and expensive to ship in a formed condition.

Such conventional methods and systems have generally been considered satisfactory for their intended purpose. However, there is still a need in the art for improved containers and blanks therefor. The present disclosure provides a solution for this need.

SUMMARY

A blank for a container configured to carry a plurality of articles can include a plurality of side panels configured to form a wall defining an interior space, a plurality of bottom panels connected to a the plurality of side panels and configured to interact with each other to form an autobottom. The autobottom can be configured to cover at least a portion of a bottom of the interior space in a formed position, and one or more divider handle assembly panels foldably connected to one or more of the bottom panels and configured to form a handle and to form at least one divider configured to divide the interior space into at least two compartments.

The plurality of side panels can include a first, second, third, and fourth side panel. The plurality of bottom panels can include a first, second, third, and fourth bottom panel foldably connected to the first, second, third, and fourth side panels, respectively.

The one or more divider handle assembly panels can include a first handle panel and a second handle panel, each including a handle aperture. The plurality of bottom panels can include or be connected to a first intermediate panel foldably connected to the first bottom panel and foldably connected to the first handle panel.

The plurality of bottom panels can include or be connected to a second intermediate panel foldably connected to the third bottom panel and foldably connected to the second handle panel. The first and second intermediate panels and the first and third bottom panels can include a triangular shape.

The blank can include one or more divider assemblies foldably connected to the second and/or fourth bottom panels, and configured to selectively further divide the interior space. The one or more divider assemblies can include a first divider assembly foldably connected to the second bottom panel and a second divider assembly foldably connected to the fourth bottom panel. The first divider assembly can include a first base panel foldably connected to the second bottom panel and a first extending panel foldably connected to the first base panel. The second divider assembly can include a second base panel foldably connected to the fourth bottom panel and a second extending panel foldably connected to the second base panel.

In certain embodiments, the one or more divider handle assembly panels can include a base panel foldably connected to one of the plurality of bottom panels. The base panel can be foldably connected to one or more divider panels. The one or more divider panels can be each connected to one or more handle panels.

A first insert cut can be defined between the third bottom panel and the third side panel. The base panel can include a first tab extending therefrom and configured to insert into the first insert cut. A second insert cut can be defined between the first side panel and the first bottom panel. A tab cut can be defined between the third bottom panel and the base panel. The tab cut can define a second tab extending from the third bottom panel and configured to insert into the second insert cut.

The one or more divider panels can include a first divider panel and a second divider panel. The one or more handle panels can include a plurality of handle panels connected to each divider panel. Each plurality of handle panels can define a handle aperture, for example. Each plurality of handle panels can be configured to form a cover over a compartment formed between the first and second divider panels when connected to the other plurality of handle panels and/or individually.

The blank can include one or more vent holes disposed between each bottom panel and each side panel. In certain embodiments, one or more vent holes can be defined between a divider handle assembly base panel and the one or more divider panels.

The one or more side panels can include or can be connected to one or more tabs extending therefrom. The one or more tabs can be configured to nest within a respective vent hole of a second container to allow stacking of containers. In certain embodiments, an attachment tab can be foldably connected to the one or more side panels to allow a first side panel to attach to another side panel.

In accordance with at least one aspect of this disclosure, a container can be formed from any embodiment of a blank disclosed herein, e.g., described above. In accordance with at least one aspect of this disclosure, an embodiment of a container configured to carry a plurality of articles can include a wall defining an interior space, and an autobottom configured to cover at least a portion of a bottom of the interior space in a formed position. The container can include one or more divider handles foldably connected to one or more bottom panels and forming a handle and forming at least one divider that divides the interior space into at least two compartments. The one or more divider handles can split the interior space into two compartments or into three compartments, for example.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
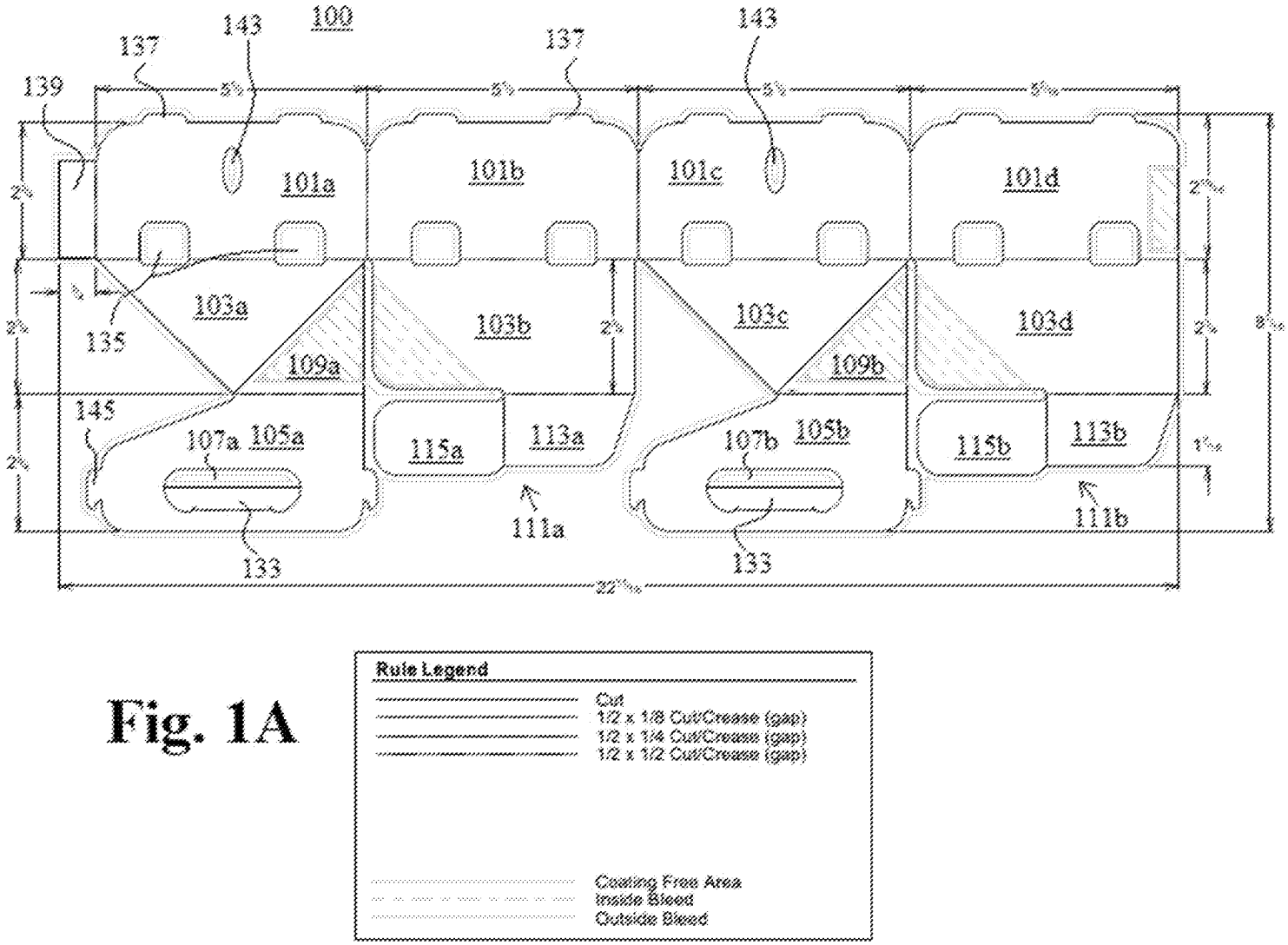
FIG. 1A is a plan view of an embodiment of a blank in accordance with this disclosure.

Reference will now be made to the drawings wherein like reference numerals identify similar structural features or aspects of the subject disclosure. For purposes of explanation and illustration, and not limitation, an illustrative view of an embodiment of a blank in accordance with the disclosure is shown in FIG. 1A and is designated generally by reference character 100. Other embodiments and/or aspects of this disclosure are shown in FIGS. 1B-2C.

Figure 1B:
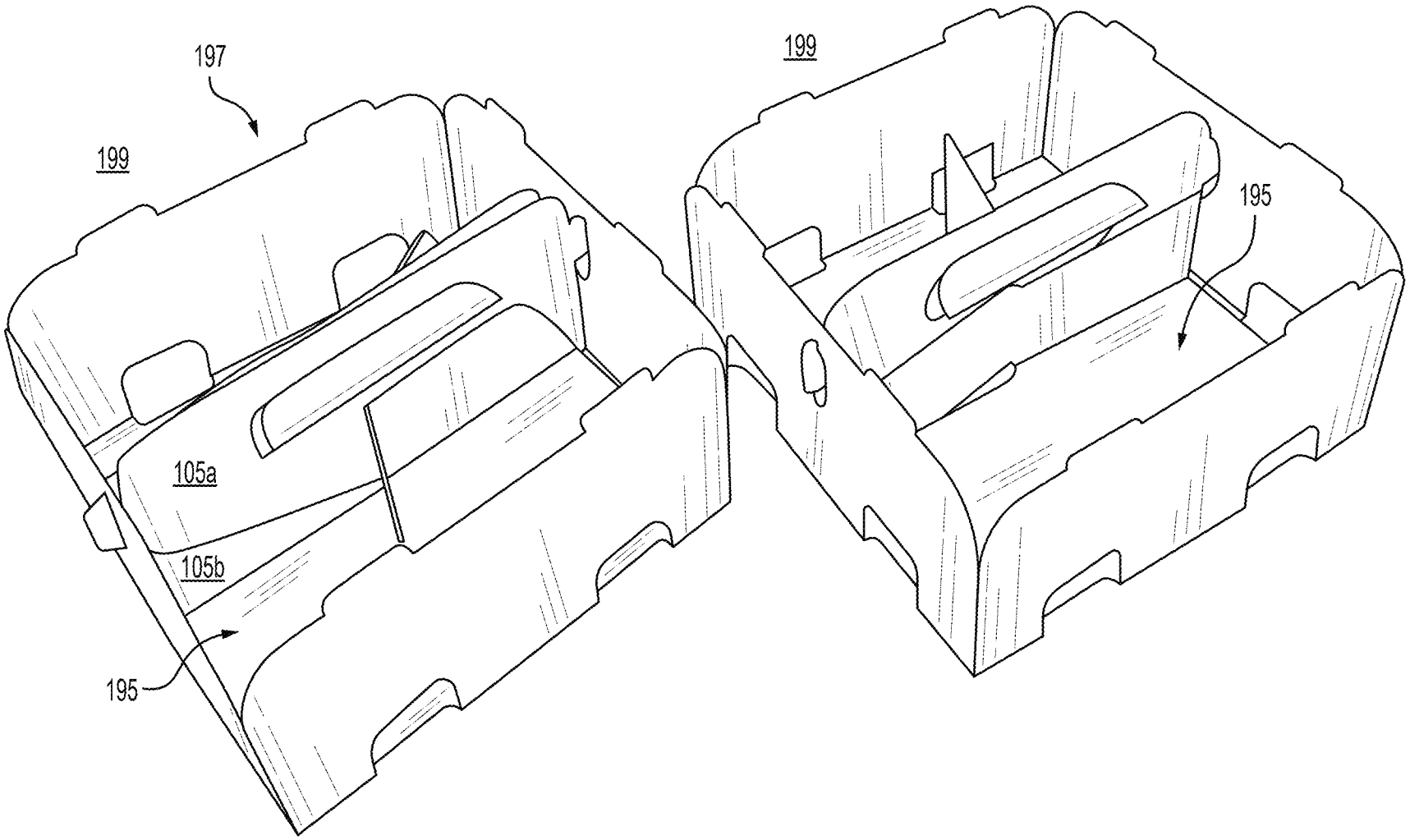
FIG. 1B is a perspective view of a plurality of an embodiment of a container formed from the blank of FIG. 1A.
Figure 1C:
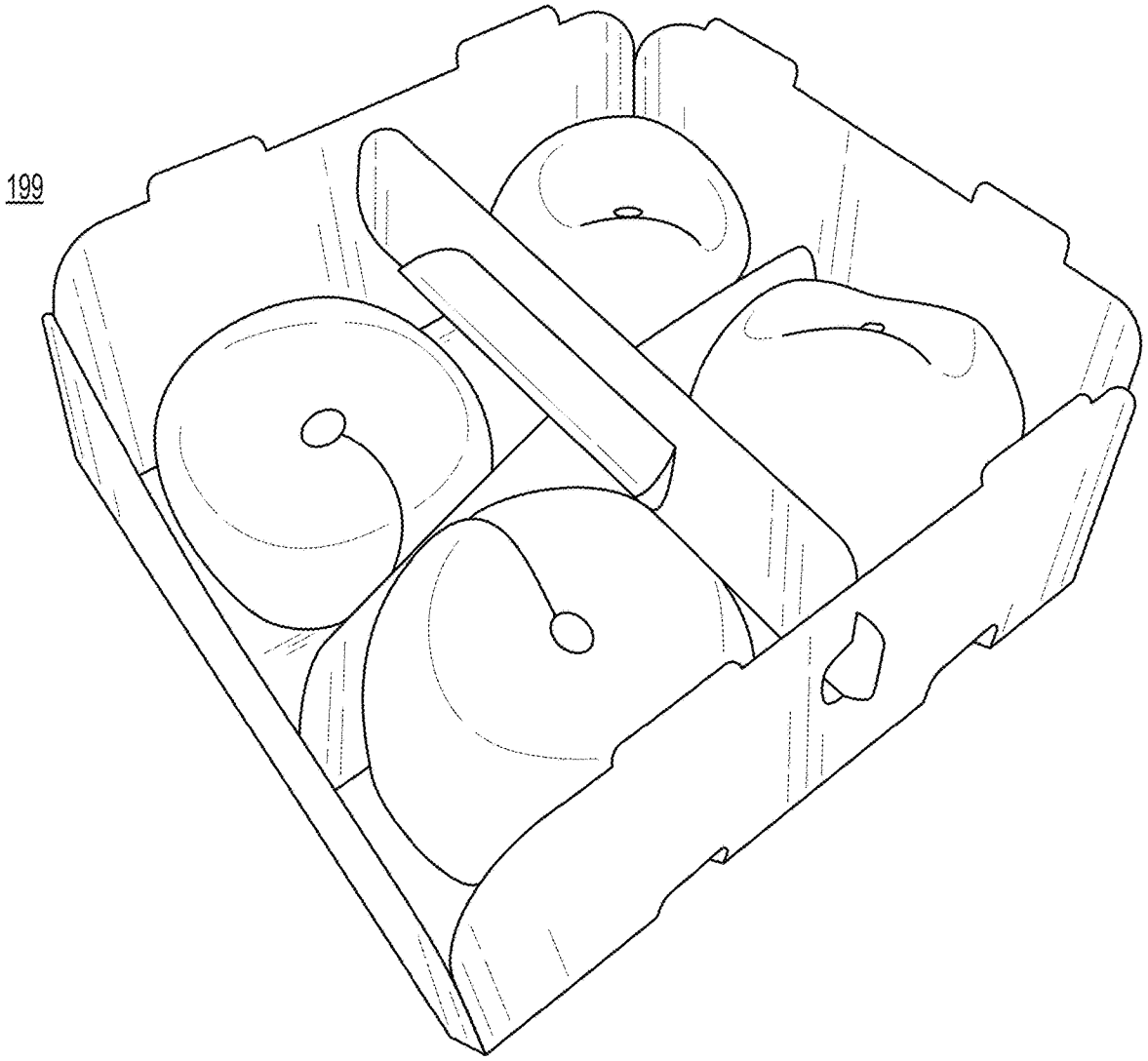
FIG. 1C is a perspective view of the container of FIG. 1B, shown configured having four compartments with product disposed therein.
Figure 2A:
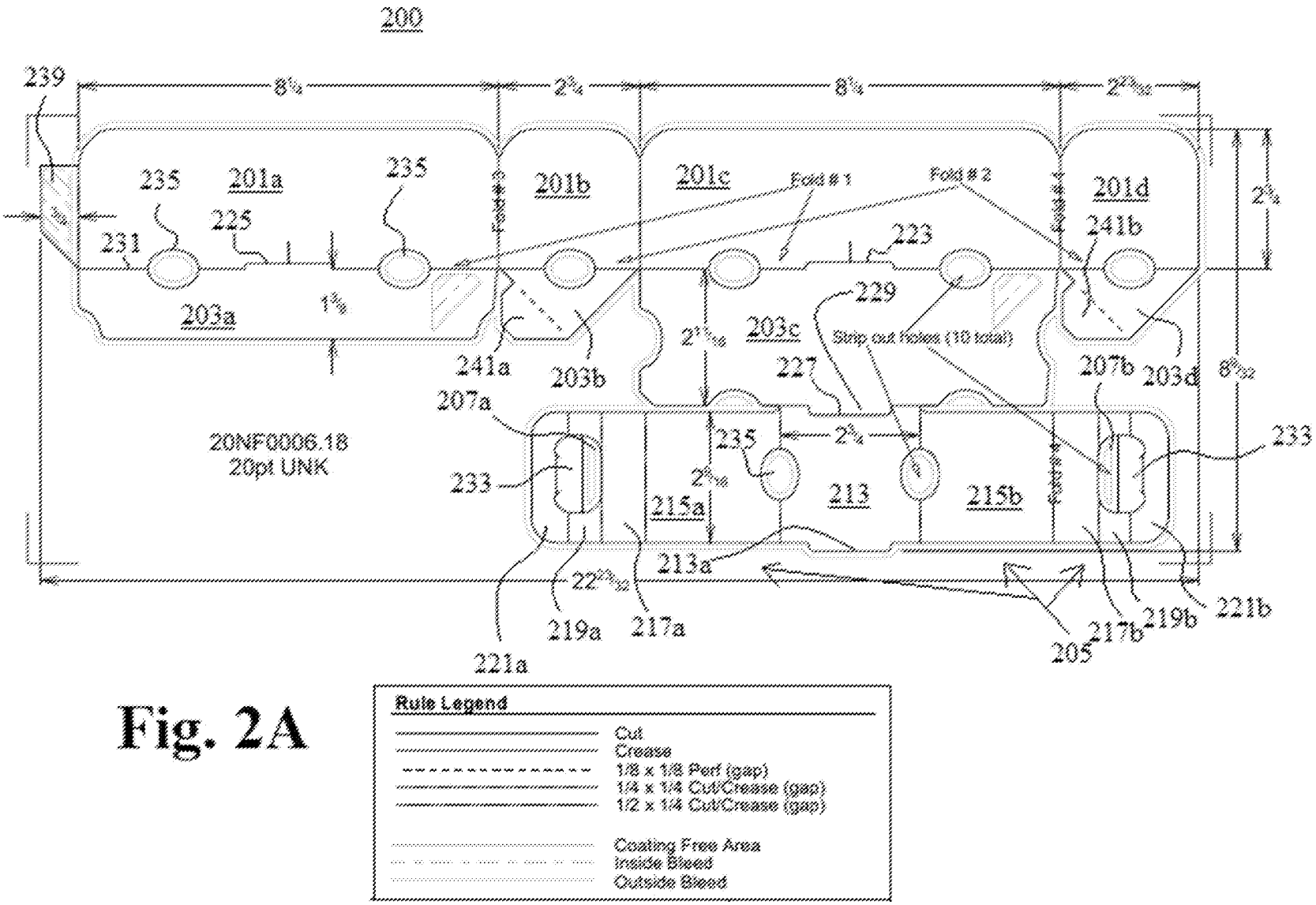
FIG. 2A is a plan view of an embodiment of a blank in accordance with this disclosure.
Figure 2B:
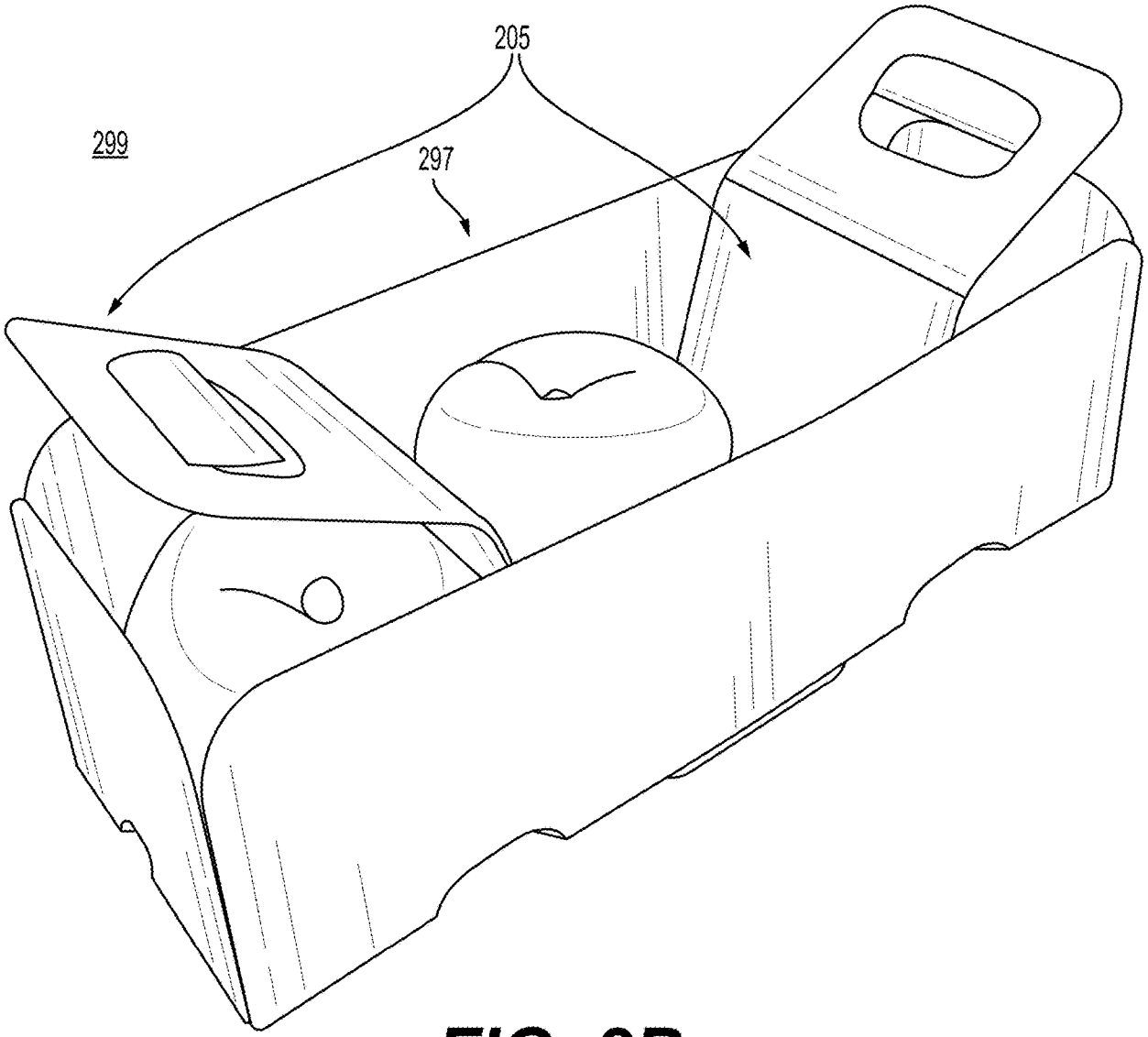
FIG. 2B is a perspective view of an embodiment of a container formed from the blank of FIG. 2C, shown having handle panels disconnected and folded outwardly with product disposed therein.

In accordance with at least one aspect of this disclosure, referring to FIGS. 1B-2C, a blank 100, 200 for a container (e.g., containers 199, 299 as shown in FIGS. 1B and 2B) configured to carry a plurality of articles can include a plurality of side panels 101*a*, 101*b*, 101*c*, 101*d*, 201*a*, 201*b*, 201*c*, 201*d* configured to form a wall (e.g., a vertical wall 197, 297 as shown in FIGS. 1B, 1C, and 2B-2D) defining an interior space (e.g., the total space within the wall). The blank 100, 200 can include a plurality of bottom panels 103*a*, 103*b*, 103*c*, 103*d*, 203*a*, 103*b*, 103*c*, 103*d* connected to the plurality of side panels 101*a-d* (e.g., foldably connected, each individually as shown).

The plurality of bottom panels 103*a-d*, 203*a-d* can be configured to interact with each other to form an autobottom 195, 295. The autobottom can be configured to cover at least a portion of a bottom of the interior space in a formed position, e.g., as shown in FIGS. 1B-1C, and 2B-2D. The autobottom 195, 295 can be configured to be moved to a flattened position to reduce the size of each container 199, 299 after assembly. Any suitable autobottom construction is contemplated herein, e.g., as appreciated by those having ordinary skill in the art in view of this disclosure.

The blank 100, 200 can include one or more divider handle assembly panels 105*a*, 105*b*, 205 foldably connected to one or more of the bottom panels 103*a-d*, 203*a-d*. The one or more divider handle assembly panels 105*a*, 105*b*, 205 can be configured to form a handle and to form at least one divider configured to divide the interior space into at least two compartments (e.g., two to four compartments as shown in FIG. 1B, and three compartments as shown in FIG. 2B). Any suitable number of divider handle assembly panels and/or any suitable shape thereof are contemplated herein.

The plurality of side panels 101*a-d*, 201*a-d* can include a first side panel 101*a*, 201*a*, a second side panel 101*b*, 201*b*, a third side panel 101*c*, 201*c*, and fourth side panel 101*d*, 201*d*. Any suitable number of side panels and/or any suitable shape thereof are contemplated herein.

The plurality of bottom panels 103*a-d*, 203*a-d* can include a first bottom panel 103*a*, 203*a*, a second bottom panel 103*b*, 203*b*, a third bottom panel 103*c*, 203*c*, and a fourth bottom panel 103*d*, 203*d* foldably connected to the first, second, third, and fourth side panels 103*a-d*, 203*a-d*, respectively, e.g., as shown. Any suitable number of bottom panels and/or any suitable shape thereof are contemplated herein.

Referring to FIG. 1A, the one or more divider handle assembly panels 105*a*, 105*b* can include a first handle panel 105*a* and a second handle panel 105*b*, each including a handle aperture 107*a*, 107*b*, for example (which can be the same or different). The handle panels 105*a*, 105*b* can be configured to also act as dividers to at least partially divide the interior space within the wall formed by the side panels 101*a-d*. The plurality of bottom panels 103*a-d* can include or be connected to a first intermediate panel 109*a* foldably connected to the first bottom panel 103*a* and foldably connected to the first handle panel 105*a*.

The plurality of bottom panels 103*a*-103*d* can include or be connected to a second intermediate panel 109*b* foldably connected to the third bottom panel 103*c* and foldably connected to the second handle panel 105*b*. The first and second intermediate panels 109*a, b* and the first and third bottom panels 103*a, c* can include a triangular shape, e.g., as shown. In certain embodiments, the fold between the bottom panels and the intermediate panels can be a 45 degree fold line relative to a fold line between the handle panels 105*a*, 105*b* and the intermediate panels 109*a*, 109*b* and/or relative to the fold line between the bottom panels 103*a*, 103*c*. Any suitable number of intermediate panels and/or shape thereof is contemplated herein.

In certain embodiments, the blank 100 can include one or more divider assemblies 111*a*, 111*b* foldably connected to the second and/or fourth bottom panels 103*b*, 103*d*. The one or more divider assemblies 111*a, b* can be configured to selectively further divide the interior space. For example, the one or more divider assemblies 111*a, b* can include a first divider assembly 111*a* foldably connected to the second bottom panel 103*b* and a second divider assembly 111*b* foldably connected to the fourth bottom panel 103*d*. Any suitable number of panels and/or shapes thereof for the divider assemblies are contemplated herein.

In certain embodiments, the first divider assembly 111*a* can include a first base panel 113*a* foldably connected to the second bottom panel 103*b* and a first extending panel 115*a* foldably connected to the first base panel 113*a*. The second divider assembly 111*b* can include a second base panel 113*b* foldably connected to the fourth bottom panel 103*d* and a second extending panel 115*b* foldably connected to the second base panel 113*b*. When assembled into a container, e.g., as shown in FIGS. 1B and 1C, the extending panels 115*a, b* can be selectively folded out relative to the based panels 113*a, b* (e.g., which can be substantially parallel with with handle panels 105*a*, 105*b*) into the interior space to further divide the interior space (e.g., into up to four total compartments in the embodiment as shown in FIG. 1C).

To form the autobottom 195, in certain embodiments, the second bottom panel 103*b* and the fourth bottom panel 103*d* can be attached (e.g., via an adhesive, tape, or any other suitable means) to the first intermediate panel 109*a* and the second intermediate panel, respectively. It is contemplated that certain embodiment, e.g., the embodiment as shown, need not have adhesive to substantially function as an autobottom while providing suitable strength.

Referring to FIG. 2A, in certain embodiments, the one or more divider handle assembly panels 205 can include a base panel 213 foldably connected to one of the plurality of bottom panels 203*a-d* (e.g., to the third panel 203*c* as shown, or any other suitable panel, e.g., the first panel 203*a*). The base panel 213 can be foldably connected to one or more divider panels 215*a*, 215*b*. The one or more divider panels 215*a*, 215*b* can be each connected to one or more handle panels 217*a, b*, 219*a, b*, 221*a, b*.

In certain embodiments, a first insert cut 223 can be defined between, e.g., the third bottom panel 203*c* and the third side panel 201*c*. The base panel 213 can include a first tab 213*a* extending therefrom and configured to insert into the first insert cut 223. A second insert 225 cut can be defined between the first side panel 201*a* and the first bottom panel 203*a*. A tab cut 227 can be defined between the third bottom panel 203*c* and the base panel 213. The tab cut can define a second tab 229 extending from the third bottom panel 203*c* and configured to insert into the second insert cut 225 (e.g., when assembly 205 is folded over bottom panel 203*c*, e.g., with first tab 213*a* inserted into insert cut 223, and side panel 201*a* folded around and bottom panel 203*a* folded on common fold line 231). Any other suitable number, position, and/or types of connections (e.g., tabs) are contemplated herein.

The one or more divider panels 215*a*, 215*b* can include a first divider panel 215*a* and a second divider panel 215*b*. The one or more handle panels 217*a, b*, 219*a, b*, 221*a, b* can include a plurality of handle panels (e.g., two or more, e.g., three or more as shown) connected to each divider panel 215*a*, 215*b*. For example, the plurality of panels 217*a*, 219*a*, 221*a* can be connected to the divider panel 215*a* and the plurality of panels 217*b*, 219*b*, 221*b* can be connected to the divider panel 215*b*. As shown, the panels 215*a, b*, 217*a, b*, 219*a, b*, 221*a, b* can be symmetric about the base panel 213. Any other suitable arrangement is contemplated herein.

Each plurality of handle panels (e.g., 219*a,b*, 221*b*) can define a handle aperture 207*a*, 207*b*, for example. As shown also in the embodiment of FIGS. 1A-1C, each handle aperture 107*a, b*, 207*a, b*, can include a handle lock tab 133, 233 connected foldably connected to a panel (e.g., panels 105*a*, 105*b*, 221*a*, 221*b* as shown) and configured to allow a user to latch the handle panels together (e.g., as appreciated by those having ordinary skill in the art).

Figure 2C:
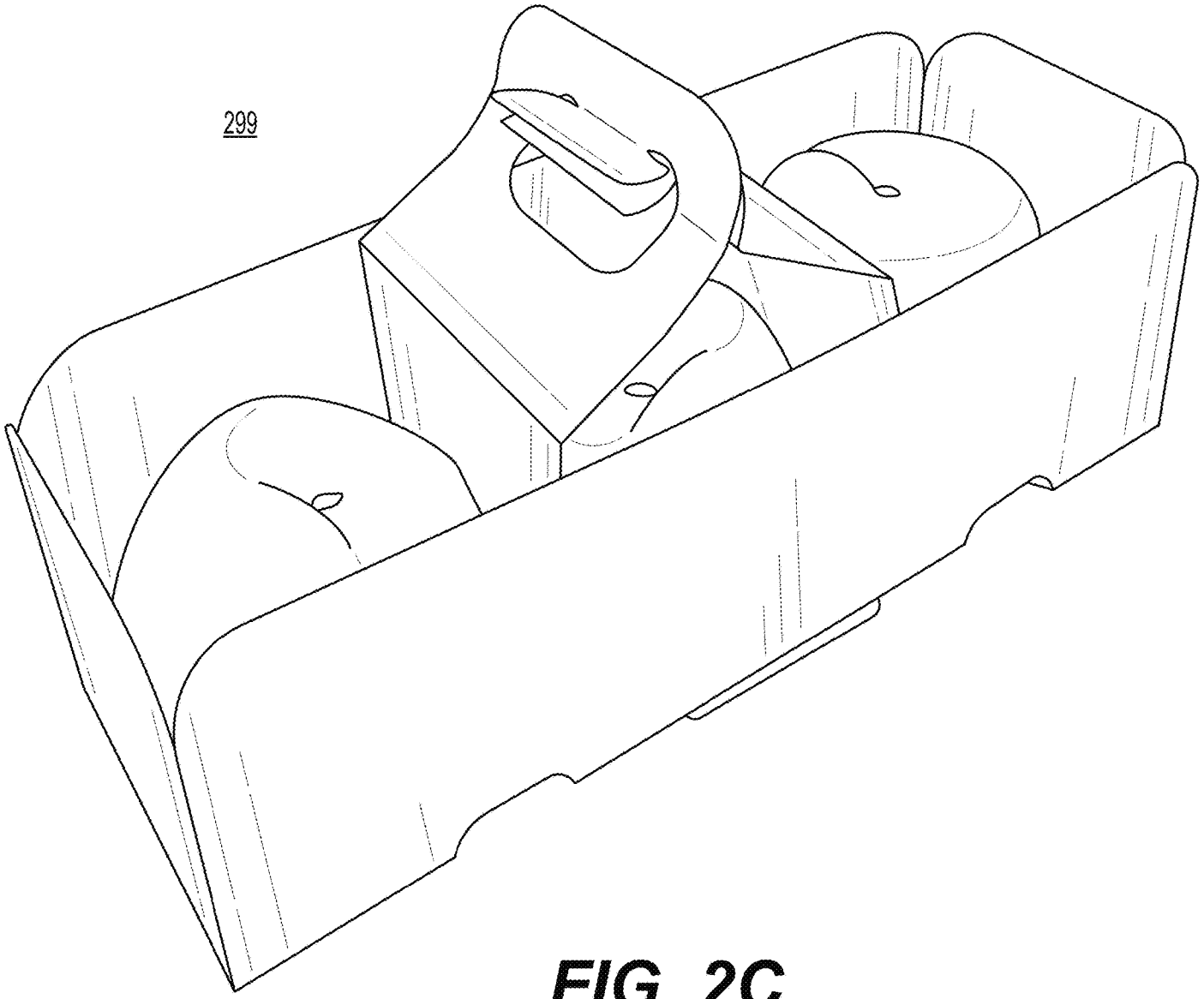
FIG. 2C is a perspective view of the embodiment of FIG. 2B, shown having handle panels folded inwardly and disconnected while forming a cover over a second compartment, allowing stacking.
Figure 2D:
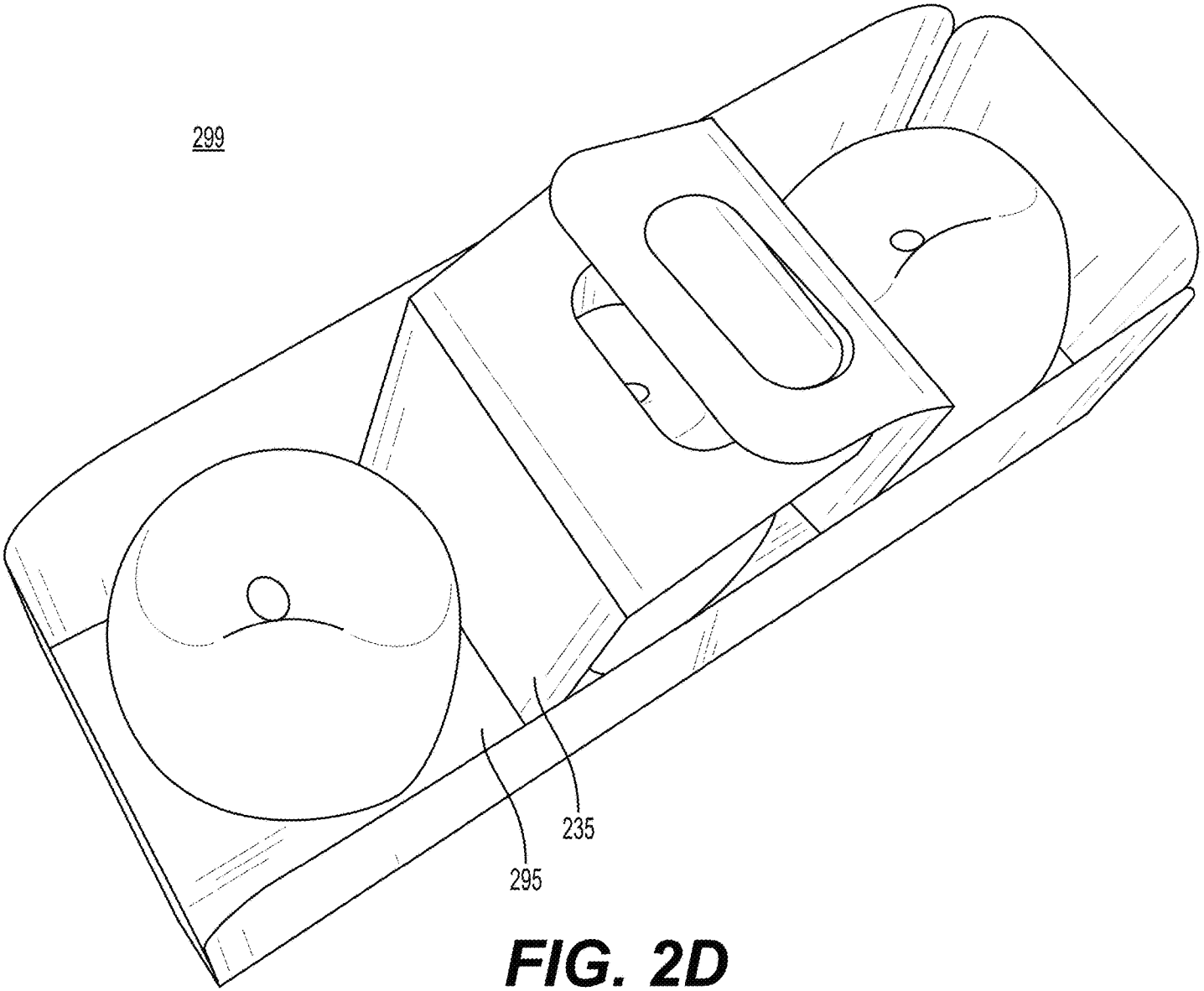
FIG. 2D is a perspective view of the embodiment of FIG. 2B, shown having handle panels folded inwardly and connected and forming a cover over a second compartment.

As shown in FIGS. 2B-2D, the plurality of handle panels can be configured to form a cover (e.g., a triangle roof shape as shown in FIG. 2C) over a compartment formed between the first and second divider panels 215*a, b* when connected to the other plurality of handle panels and/or individually. Any other suitable function for the handle panels (e.g., to individually cover other compartments in the container 200 as shown in FIG. 2B, or to collapse as shown in FIG. 2C to allow stacking) is contemplated herein.

Referring to FIGS. 1A-2D, the blank 100, 200 can include one or more vent holes 135, 235 disposed between each bottom panel 103*a-d*, 203*a-d* and each side panel 101*a-d*, 201*a-d*. In certain embodiments, e.g., as shown in FIG. 2A, one or more vent holes 235 can be defined between a divider handle assembly base panel 213 and the one or more divider panels 215*a, b*.

As shown in FIG. 1A, the one or more side panels 101*a-d* can include or can be connected to one or more tabs 137 extending therefrom. The one or more tabs 137 can be configured to nest within a respective vent hole 135 of a second container 199 to allow stacking and/or interlocking of containers 199, for example. In certain embodiments, an attachment tab 139, 239 can be foldably connected to the one or more side panels 101*a-d*, 201*a-d* to allow a first side panel 101*a*, 201*a* to attach to another side panel (e.g., a last side panel 101*d*, 201*d*), e.g., with an adhesive or any other suitable attachment.

In certain embodiments, as shown in FIGS. 1A-1C, the first and third side panels 101*a*, 101*c* can include one or more connector holes 143. The handle panels 105*a*, 105*b* can include one or more connectors 145 (e.g., hooks as shown) configured to insert into the one or more connector holes 143 when folded to allow the side panels 101*a*, 101*c* to interact with the handle panels 105*a*, 105*b* such that force is transmitted to the side panels when lifting such that the handle panels 105*a*, 105*b* cannot pull out of the interior space. Any suitable fixation of the handle panels to the side panels is contemplated herein.

In certain embodiments, referring to FIG. 2A, the second and fourth bottom panels 203*b*, 203*d* can include or be connected to a folding panel 241*a*, 241*b* that is foldably connected to the bottom panels 203*b*, 203*d*. The folding panels 241*a*, 241*b* can be configured to attach to the first bottom panel 203*a* and third bottom panels, respectively, (e.g., via an adhesive or other suitable attachment) to form the autobottom 295. Any other suitable panels and/or arrangements for a blank 100, 200 are contemplated herein.

In accordance with at least one aspect of this disclosure, a container, e.g., containers 199, 299 can be formed from any embodiment of a blank, e.g., 100, 200 disclosed herein, e.g., described above. In accordance with at least one aspect of this disclosure, an embodiment of a container 199, 299 configured to carry a plurality of articles can include a wall 197, 297 defining an interior space, and an autobottom 195, 295 configured to cover at least a portion of a bottom of the interior space in a formed position (e.g., as shown in FIGS. 1B, 1C, and 2B-2D). The container 100, 200 can include one or more divider handles 105*a*, 105*b*, 205 foldably connected to the one or more bottom panels 103*a-d*, 203*a-d*, and forming a handle and forming at least one divider that divides the interior space into at least two compartments. The one or more divider handles alone can split the interior space into two compartments (e.g., as shown in FIGS. 1B-1C) or into three compartments (e.g., as shown in FIGS. 2B-2D), for example. Any suitable split or number of compartments, permanent or selectable is contemplated herein.

Any suitable blank to form any suitable container disclosed herein, e.g., described above is contemplated herein. One having ordinary skill in the art appreciates how to form a package, e.g., as shown, from the blanks, e.g., as shown, without undue experimentation.

Embodiments can include a container having an autobottom with with an integral handle/divider foldably connected. Embodiments may not need glue to assemble this and still function. Embodiments can include tabs that nest in vent holes of a second container to allow stacking. Embodiments can include dividers that can be folded over to create two, three, or four compartment carrier. Embodiments can include a handle that is flush with a top (of a vertical wall) to allow for stacking. In certain embodiments, the handle can stick out above Certain embodiments include a basket/carrier that can be all one piece including an auto bottom style base (e.g., with or without modified gluing) and a multifunctional handle/divider attached. Embodiments can incorporate tabs, e.g., rectangular feet, along walls for ease of stacking and nesting. Embodiments can also include vent holes, e.g., die cut squares, to allow for ventilation and also deliver a basket aesthetic. Certain embodiments can include scalloped side panels, for example.

Embodiments can be used for bakery/deli applications, retail chains, take-out food (sporting events, doughnuts, fast food), beverages (beer/cans), pies, mini pies, other desserts, produce (e.g., fruits), and any other suitable products.

Embodiments can provide a sustainable alternative for current plastic baskets. Another advantage is ease of assembly and the multifunctional divider handle.

Any suitable adhesive can be applied to any suitable panel disclosed herein for any suitable purpose. Any suitable foldable line types are contemplated herein (e.g., perforated, creased, cut/creased, etc.). While the figures may include a legend indicating the line types of the embodiments of the figures, any other suitable line types for the lines shown in the drawings are contemplated herein. Any other suitable panel arrangement (e.g., more or less panels in any suitable location) is contemplated herein.

While embodiments have been described and shown above, any suitable panels and/or other design for a blank to form a package as disclosed above is contemplated herein. Any suitable material for use (e.g., paper, cardboard, plastic board, etc.) and/or one or more combinations thereof are contemplated herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of"

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A blank for a container configured to carry a plurality of articles, comprising:

a plurality of side panels configured to form walls defining an interior space;

a plurality of bottom panels connected to the plurality of side panels and configured to interact with each other to form an autobottom, wherein the autobottom is configured to cover at least a portion of a bottom of the interior space in a formed position;

one or more divider handle assembly panels foldably connected to one or more of the bottom panels and configured to form a handle and to form at least one divider configured to divide the interior space into at least two compartments, wherein the one or more divider handle assembly panels comprise a first handle panel and a second handle panel, wherein a first one of the plurality of bottom panels comprises or is connected to a first intermediate panel that is connected to the first handle panel of the divider handle assembly along a fold line where the first handle panel meets the first intermediate panel; and one or more divider assemblies foldably connected to another one or more of the bottom panels, respectively, and configured to selectively further divide the interior space, wherein each of the one or more divider assemblies comprises a divider assembly panel configured to be folded such that at least a portion thereof is disposed substantially parallel to one of the one or more divider handle assembly panels, wherein the first handle panel of the divider handle assembly and the second handle panel of the divider handle assembly is configured to form the handle, which is separate from the one or more divider assemblies.

2. The blank of claim 1, wherein the plurality of side panels comprise a first, second, third, and fourth side panel.

3. The blank of claim 2, wherein the plurality of bottom panels comprise a first, second, third, and fourth bottom panel foldably connected to the first, second, third, and fourth side panels, respectively.

4. The blank of claim 1, wherein each of the first handle panel and the second handle panel of the divider handle assembly comprises a handle aperture.

5. The blank of claim 4, wherein the first one of the plurality of bottom panels is the first bottom panel and the first intermediate panel is foldably connected to the first bottom panel along the fold line.

6. The blank of claim 5, wherein another one of the plurality of bottom panels comprises or is connected to a second intermediate panel that is foldably connected to the third bottom panel and foldably connected to the second handle panel.

7. The blank of claim 6, wherein the first and second intermediate panels and the first and third bottom panels comprise a triangular shape.

8. The blank of claim 7, wherein the one or more divider assemblies are foldably connected to the second and/or fourth bottom panels and configured to selectively further divide the interior space.

9. The blank of claim 6, wherein the one or more divider assemblies comprise a first divider assembly foldably connected to the second bottom panel and a second divider assembly foldably connected to the fourth bottom panel, wherein the first divider assembly comprises a first base panel as the divider assembly panel that is foldably connected to the second bottom panel, and a first extending panel foldably connected to the first base panel, and wherein the second divider assembly comprises a second base panel foldably connected to the fourth bottom panel and wherein the at least one extending panel comprises a second extending panel foldably connected to the second base panel.

10. The blank of claim 1, further comprising one or more vent holes disposed between each bottom panel and each side panel.

11. The blank of claim 10, wherein the one or more side panels comprise or are connected to one or more tabs extending therefrom, wherein the tabs are configured to nest within a respective vent hole of a second container to allow stacking of containers.

12. The blank of claim 1, further comprising an attachment tab foldably connected to the one or more side panels to allow a first side panel to attach to another side panel.

13. A container configured to carry a plurality of articles, comprising:

a series of walls defining an interior space;

an autobottom that is configured to cover at least a portion of a bottom of the interior space in a formed position;

one or more divider handles foldably connected to one or more bottom panels and forming a handle and forming at least one divider that divides the interior space into at least two compartments, wherein a first one of the one or more bottom panels comprises or is connected to a first intermediate panel that is connected to a first divider handle among the one or more divider handles along a fold line where the divider handle meets the first intermediate panel; and one or more divider assemblies foldably connected to another one or more of the bottom panels, respectively, the one or more divider assemblies further dividing the interior space, wherein each of the one or more divider assemblies comprises a divider assembly panel disposed substantially parallel to one of the one or more divider handles, wherein the one or more divider handles comprises a first handle and a second handle configured to form the handle, which is separate from the one or more divider assemblies.

14. The container of claim 13, wherein the one or more divider handles split the interior space selectively into two compartments or into three compartments.

15. A blank for a container configured to carry a plurality of articles, comprising:

a plurality of side panels configured to form walls defining an interior space;

a plurality of bottom panels connected to the plurality of side panels and configured to interact with each other to form an autobottom, wherein the autobottom is configured to cover at least a portion of a bottom of the interior space in a formed position, and at least one base panel foldably connected to one of the plurality of bottom panels, respectively, wherein the base panel does not form part of the autobottom, wherein each base panel is foldably connected to two or more divider panels, wherein each of the two or more divider panels is connected to one or more handle panels.

16. The blank of claim 15, wherein the plurality of side panels comprise a first, second, third and fourth side panel and the plurality of bottom panels comprise a first, second, third and fourth bottom panel foldably connected to the first, second, third, and fourth side panels, respectively.

17. The blank of claim 16, wherein a first insert cut is defined between the third bottom panel and the third side panel, wherein the base panel comprises a first tab extending therefrom and configured to be inserted into the first insert cut.

18. The blank of claim 17, wherein a second insert cut is defined between the first side panel and the first bottom panel, wherein a tab cut is defined between the third bottom panel and the base panel, and wherein the tab cut defines a second tab extending from the third bottom panel and configured to be inserted into the second insert cut.

19. The blank of claim 15, wherein the two or more divider panels comprise a first divider panel and a second divider panel, wherein the one or more handle panels comprise a plurality of handle panels connected to each divider panel, each of the plurality of handle panels comprising a handle aperture defined therein.

20. The blank of claim 19, wherein each of the plurality of handle panels is configured to form a cover over a compartment formed between the first and second divider panels when connected to the other of the plurality of handle panels and/or individually.

* * * * *